US005722825A

United States Patent [19]

Edenhofer

[11] Patent Number: 5,722,825

[45] Date of Patent: Mar. 3, 1998

[54] DEVICE FOR HEAT-TREATING METALLIC WORK PIECES IN A VACUUM

[75] Inventor: Bernd Edenhofer, Kleve, Germany

[73] Assignee: Ipsen Industries International GmbH, Kleve, Germany

[21] Appl. No.: 624,965

[22] Filed: Mar. 29, 1996

[30] Foreign Application Priority Data

Mar. 31, 1995 [DE] Germany ..... 295 05 496 U

[51] Int. Cl.[6] ..... F27B 9/02; F27B 9/18; F27B 9/26

[52] U.S. Cl. ..... 432/138; 432/137; 432/128; 432/153; 266/251

[58] Field of Search ..... 266/250, 251; 432/124, 128, 131, 137, 138, 153

[56] References Cited

U.S. PATENT DOCUMENTS

| | | | |
|---|---|---|---|
| 4,622,006 | 11/1986 | Hohne | 432/128 |
| 4,938,458 | 7/1990 | Nakajima . | |
| 5,143,558 | 9/1992 | Smith | 266/252 |

FOREIGN PATENT DOCUMENTS

| | | |
|---|---|---|
| 0088995 | 9/1983 | European Pat. Off. . |
| 0530513 | 3/1993 | European Pat. Off. . |
| 2617953 | 1/1989 | France . |
| 8711235 | 12/1987 | Germany . |
| 8602103 | 4/1986 | Sweden . |
| 2162208 | 1/1986 | United Kingdom . |

*Primary Examiner*—Henry A. Bennett
*Assistant Examiner*—Gregory Wilson
*Attorney, Agent, or Firm*—Robert W. Becker & Associates

[57] ABSTRACT

A device for heat-treating metallic workpieces in a vacuum has a revolving vacuum furnace with an inlet transfer lock for introducing a batch of workpieces into the revolving vacuum furnace and with an outlet transfer lock for removing the batch of workpieces from the revolving vacuum furnace. The revolving vacuum furnace has also an annular turntable for transporting the batch of workpieces from the inlet transfer lock to the outlet transfer lock. At least one carburization furnace, for carburization treatment of the batch of workpieces, is connected to the revolving vacuum furnace at least at a peripheral location of the revolving vacuum furnace between the inlet transfer lock and the outlet transfer lock in the direction of transportation of the batch of workpieces. The annular turntable transports the batch of workpieces to the at least one carburization furnace.

12 Claims, 2 Drawing Sheets

DEVICE FOR HEAT-TREATING METALLIC WORK PIECES IN A VACUUM

BACKGROUND OF THE INVENTION

The present invention relates to a device for heat-treating metallic work pieces in a vacuum within a revolving furnace having an annular turntable as well as an inlet transfer lock and an outlet transfer lock whereby the batch of workpieces is movable with the annular turntable to different treatment positions.

Such a device in which the workpieces to be treated are advanced with a turntable to different treatment positions, is, for example, known from German Patent 40 05 956. In this device, the turntable which is arranged in a vacuum chamber is divided by partitions into separate chambers so that different treatments at various treatment positions can be preformed. For a respective treatment, the batches of workpieces arranged within the partitioned chambers are advanced to different positions within the vacuum chamber where the workpieces are subjected to various plasma treatment and/or heat treatment steps.

It is possible with the known device to subject different charges to different treatments; however, the flexibilty of these known devices is limited because the residence time of the charges depends on the longest required treatment period of one batch, because all batches are arranged on a common turntable and the movement of the turntable to a new treatment position or to the outlet transfer lock can only be performed when all treatment steps at the individual positions have been completed.

From European Patent 0 198 871 it is known to use a revolving furnace for treating metallic workpieces in a carburization atmosphere. In this known device, to a first revolving furnace in which the carburization phase is preformed, a second revolving furnace or a pusher-type furnace is provided for the diffusion phase. This apparatus design as well as the aforementioned apparatus design according to German Patent 40 05 956 are essentially suitable for two-step carburization processes which consist of the carburization phase and a diffusion phase performed in sequence.

For vacuum processes or plasma processes in which a plurality of carburization phases and a plurality of diffusion phases must be performed alternatingly in sequence, these known apparatus designs are not suitable or are not flexible enough.

Due to the high material transmission rate during vacuum processes and plasma processes, in which within a few minutes the carbide limit has been reached, a diffusion phase must be performed subsequent to this material transmission phase in order for the carbon content at the boundary layer to be lowered before a subsequent material transmission phase. Depending on the desired hardening depth, this change between material transmission phase and diffusion phase must be performed a plurality of times in sequence. Since in the device according to German Patent 40 05 956 the same atmosphere is present in the entire vacuum chamber, the carburization conditions for individual batches can not be changed without affecting the other batches arranged within the revolving furnace.

It is therefore an object of the present invention to provide a device for heat treating metallic work pieces in vacuum. With the device a flexible exchange between different batches of different hardening depth is possible without affecting other batches by changing the carburization conditions.

SUMMARY OF THE INVENTION

A device for heat-treating metallic workpieces in vacuum according to the present invention is primarily characterized by:

a revolving vacuum furnace comprising an inlet transfer lock for introducing batches of workpieces into the revolving vacuum furnace and an outlet transfer lock for removing batches of workpieces from the revolving vacuum furnace;

the revolving vacuum furnace further comprising an annular turntable for transporting the batch of workpieces from the inlet transfer lock to the outlet transfer lock;

at least on carburization furnace for carburization treatment of the batches of workpieces, connected to the revolving vacuum furnace at least at a peripheral location of the revolving vacuum furnace between the inlet transfer lock and the outlet transfer lock in a direction of transport of the batches of workpieces, wherein the annular turntable transports the batches of workpieces to the at least one carburization furnace.

Advantageously, the at least one carburization furnace is a plasma furnace or a vacuum furnace.

Expediently, the device further comprises at least one heating chamber positioned between the inlet transfer lock and the revolving vacuum furnace.

Preferably, the device further comprises at least one compensation chamber positioned between the heating chamber and the revolving vacuum furnace.

In yet another embodiment of the present invention the at least one compensation chamber is a hydrogen sputter chamber for surface-cleaning the workpieces.

Preferably, the outlet transfer lock is a cooling chamber. The cooling chamber is preferably a quenching chamber employing gas for quenching.

In the alternative, the cooling chamber may comprise a quenching bath containing a liquid.

Preferably, the device further comprises a tempering furnace positioned between the outlet transfer lock and the revolving vacuum furnace.

Advantageously, the at least one carburization furnace comprises a first pushing device for pushing the batch of workpieces from the annular turntable to the at least one carburization furnace and a second pushing device for pushing the batches of workpieces from the at least one carburization furnace back onto the annular turntable.

Preferably, the first and second pushing devices are electrical, pneumatic, or hydraulic pushing devices.

According to the present invention, the revolving furnace is an annular vacuum furnace for performing the diffusion phase and at the periphery of the revolving vacuum furnace at least in the area between the inlet transfer lock and the outlet transfer lock at least one separate carburization furnace is arranged into which the batches of workpieces can be introduced for carburization treatment.

The primary advantage of this inventive design is that the revolving vacuum furnace is used only for the diffusion step, while the batches of workpieces can be introduced, if necessary, for the carburization phase into one of the carburization chambers which are arranged separately at the revolving furnace. After completion of a carburization process, the batch of workpieces is returned into the revolving vacuum furnace for diffusion until the batch of workpieces is again introduced into a further carburization furnace for a subsequent carburization process or, after completion of the carburization process, is removed via the outlet transfer lock from the revolving vacuum furnace. The carburization furnaces may be embodied for the inventive revolving furnace as plasma furnaces or vacuum furnaces.

In order to preheat the workpieces to the desired treatment temperature before introduction into the revolving vacuum furnace via the inlet transfer lock, according to a further advantageous embodiment of the invention, at least one heating chamber is arranged between the inlet transfer lock and the revolving vacuum furnace. Since heating of the batch of workpieces is carried out from the exterior, it may be advantageous, especially with respect to massive (solid) workpieces, to provide a temperature compensation chamber between the heating chamber and the revolving vacuum furnace. Within the compensation chamber a uniform temperature distribution within the batch of the workpieces can be adjusted.

According to a further embodiment of the invention, the compensation chamber may be a hydrogen sputter chamber for surface-cleaning of the workpieces. Such a surface cleaning of the workpieces with a hydrogen plasma is especially advantageous when the carburization furnace connected to the revolving vacuum furnace is a plasma furnace.

According to an alternative embodiment the outlet transfer lock is a cooling chamber. The embodiment of the outlet transfer lock as a cooling chamber allows for an especially space-saving and compact construction of the device. According to further embodiments of the invention, the cooling chamber can be a quenching chamber in which gas is used for quenching or can have a quenching bath containing a liquid.

In order to be able to treat batches of workpieces in which the carburization temperature within the carburization furnace is substantially greater than the tempering (annealing) temperature, it is possible to interpose between the revolving vacuum furnace and the cooling chamber a tempering furnace in which the batches of workpieces are first cooled to the desired tempering temperature before subsequently being quenched in the cooling chamber.

For moving the batches of workpieces from the revolving vacuum furnace into the carburization chamber of the carburization furnace, respectively, for moving the batch of workpieces from the carburization furnace back into the revolving vacuum furnace, each one of the carburization furnaces is provided with two pushing devices which are operated either electrically, pneumatically, or hydraulically.

BRIEF DESCRIPTION OF THE DRAWINGS

The object and advantage of the present invention will appear more clearly in the following specification in conjunction with the accompanying drawings, in which.

DESCRIPTION OF PREFERRED EMBODIMENT

The present invention will now be described in detail with the aid of several specific embodiments utilizing FIGS. 1 and 2.

Figure 1:
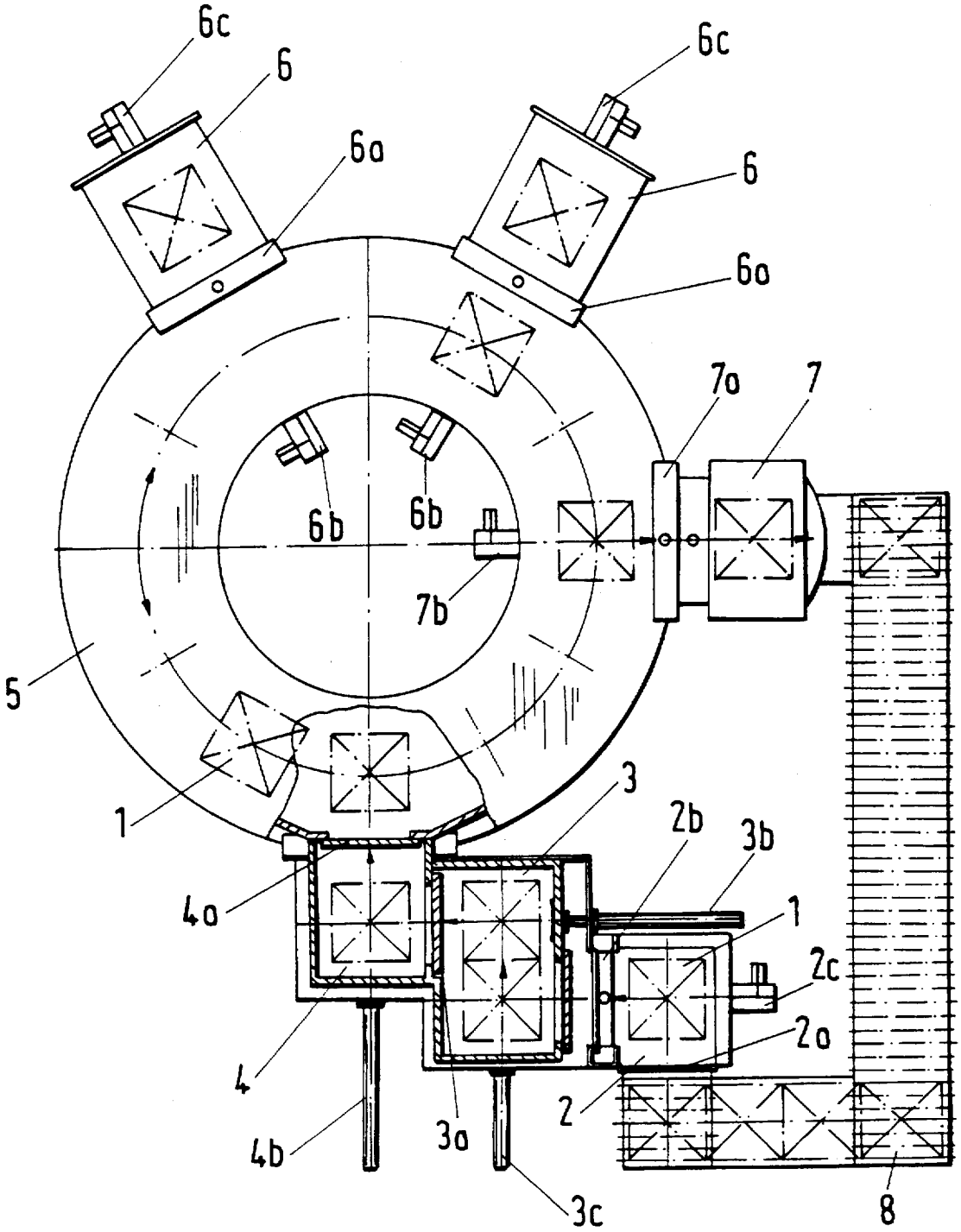
FIG. 1 shows a schematic representation of a first embodiment of a revolving vacuum furnace.

The device represented in FIG. 1 for heat-treating metallic workpieces in batches 1 is comprised, when viewed in the direction of transportation of the batches 1, of an inlet transfer lock 2, a heating chamber 3, a compensation chamber 4, a revolving vacuum furnace 5 as a diffusion furnace, two carburization furnaces 6, as well as an outlet transfer lock 7.

From a non-represented batch storage device the batches 1 of workpieces are transported via a transporting device 8 to the inlet transfer lock 2. After loading into the inlet transfer lock 2, the doors 2*a* and 2*b* of the inlet transfer lock 2 are closed and the inlet transfer lock 2 is evacuated with a non-represented pump because the subsequent treatment steps for the batches 1 in the chambers 3 and 4 as well as in the revolving furnace 5 are to be carried out under vacuum. Subsequently, the door 2*b* is opened. The batch 1 is transported with a pushing device 2*c* into the heating chamber 3, and the door 2*b* is again locked.

The heating chamber has two sites for receiving batches 1. The batch 1 is heated with non-represented heating means to the desired treatment temperature, i.e., to a temperature which is also present within the revolving vacuum furnace 5.

A compensation chamber 4 is connected to the heating chamber 3. Between the heating chamber 3 and the compensation chamber 4 a door 3*a* is arranged. The transport of the batch 1 within the heating chamber 3 is performed with a pushing device 3*c* and the transport from the heating chamber 3 into the compensation chamber 4 is performed with a pushing device 3*b*. As soon as a batch 1 has been moved out of the heating chamber 3 into the compensation chamber 4, a new batch 1 is introduced into the heating chamber 3 via the inlet transfer lock 2.

Since heating of the batches 1 within the heating chamber 3 is carried out exclusively from the exterior by radiation, especially massive workpieces still have a non-uniform temperature distribution after the surface has already reached the treatment temperature. Therefore, the batch 1 is removed from the heating chamber 3 so that the workpiece will not be subjected unnecessarily to high temperatures. In the compensation chamber 4 which is also provided with non-represented heating means, the temperature of the workpieces equilibrate. For this purpose, the temperature in the compensation chamber 4 is controlled such that it is always adjusted to a set temperature, i.e., the desired treatment temperature. The conventional treatment temperatures are between 800° C. and 1000° C.

After reaching the treatment temperature, the batch 1, after opening the door 4*a*, is pushed with the pushing device 4*b* into the revolving vacuum furnace 5 and the door 4*a* is again closed. With the annular turntable of the revolving furnace 5 the batch 1 is directly transported to the carburization furnace 6. The chamber of the carburization furnace 6 is evacuated before introduction of the batch 1 with a non-represented pump. After opening the door 6*a* upon completion of evacuation, the batch 1 is introduced into the carburization furnace 6 with a pushing device 6*b* connected to the inner side of the revolving vacuum furnace 5 and the furnace door 6*a* is again closed. In the chamber of the carburization furnace, which is either a plasma furnace or a vacuum furnace, the actual carburization process takes place. After completion of the predetermined carburization interval, the carburization furnace is switched off and the process gas is optionally removed from the carburization chamber 6. After evacuating the carburization chamber, the furnace door 6*a* is again opened and the batch 1 is returned into the revolving vacuum furnace 5 by a pushing device 6*c* positioned opposite the first pushing device 6*b*.

Within the revolving vacuum furnace 5 the diffusion phase, which takes place under vacuum at a constant temperature subsequent to the carburization process, in order to lower in the boundary layer the carbon contents. Depending on the desired depth of hardness, the disclosed carburization process and the subsequent diffusion phase are repeated multiple times. Due to the design of the device, including the revolving vacuum furnace 5 for the diffusion phase and the carburization chambers of the furnaces 6 arranged at the exterior to be used for the actual carburization process, an optimal use of the device is ensured: while a batch 1 that has already been treated in the carburization furnace 6 resides within the revolving vacuum furnace 5 for undergoing a diffusion phase, another batch 1 with optionally differently adjusted carburization specifications can be introduced into the carburization furnace 6. Depending on how many carburization furnaces 6 are arranged along the periphery of the revolving vacuum furnace 5, the operational flexibility of the inventive device can be increased and the treatment time can be reduced.

As soon as the last diffusion process has been terminated within the revolving furnace 5, the batch 1 is transported to the door 7*a* of the outlet transfer lock 7. Subsequently, the outlet transfer lock 7 is evacuated, the door 7*a* opened, and the batch 1 transported with a pushing device 7*b* into the outlet transfer lock 7. After closure of the door 7*a*, the batch 1 within the outlet transfer lock 7 in the form of a cooling chamber can be quenched with gas or with a liquid bath.

Figure 2:
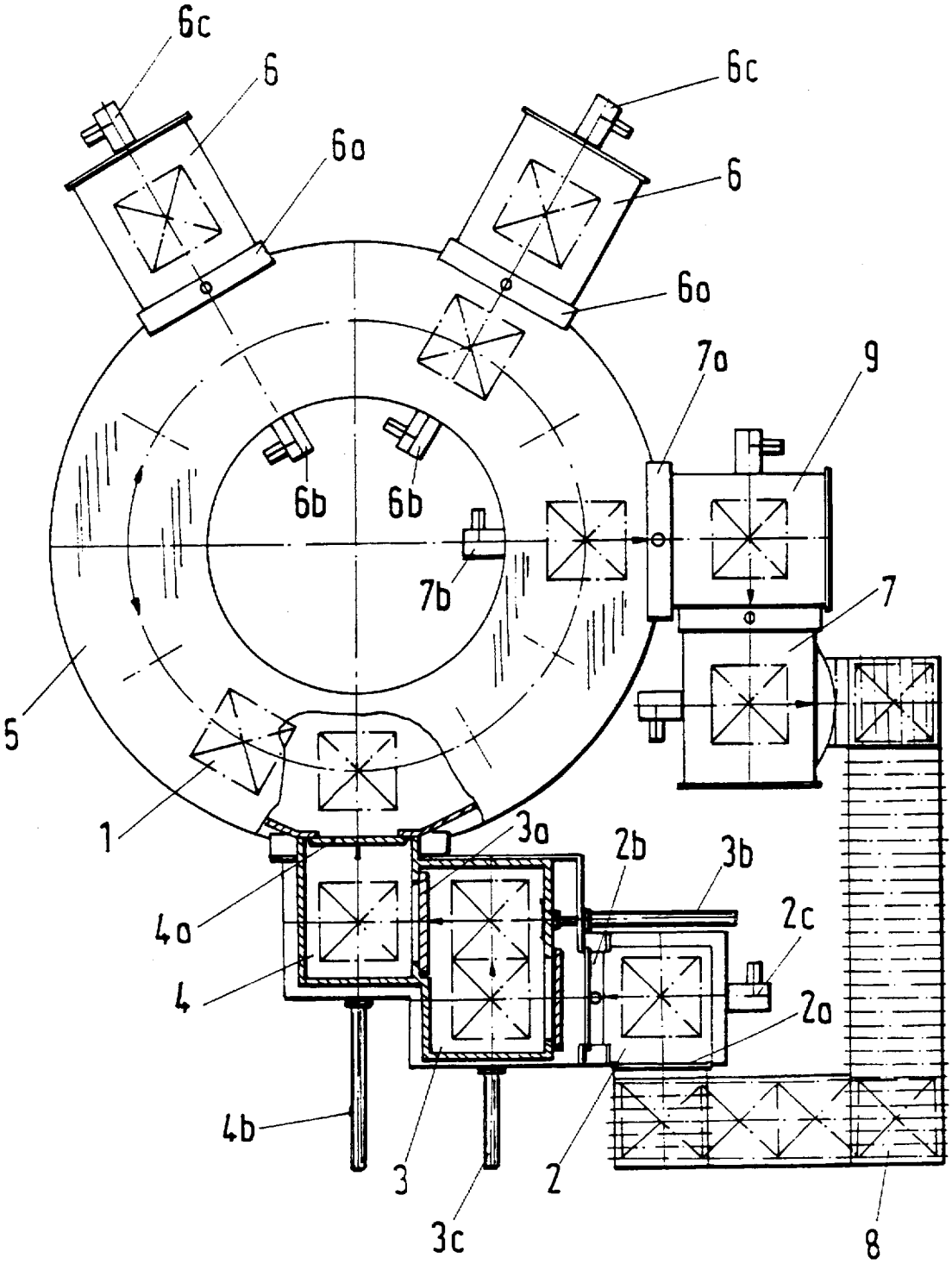
FIG. 2 shows a schematic representation of a second embodiment of a revolving vacuum furnace.

The second embodiment of the invention represented in FIG. 2 is identical to the device of FIG. 1 with the exception of the area of the outlet transfer lock 7. In this alternative embodiment, between the revolving vacuum furnace 5 and the outlet transfer lock 7 in the form of a cooling chamber a tempering furnace (annealing furnace) 9 is positioned. Such a tempering furnace 9 is required when the carburization temperature within the carburization furnace 6 is substantially greater than the annealing or tempering temperature of the batch 1 and the batch 1, after the carburization process and before quenching, must be cooled to the desired tempering temperature. For this purpose, the batch 1 is first guided through the tempering furnace 9 after completion of the last diffusion phase within the revolving vacuum furnace 5 and is then transported into the cooling chamber of the outlet transfer lock 7 where it is quenched.

With the inventive device for heat-treating metallic workpieces it is thus ensured that batches of workpieces with very different tempering conditions can be treated simultaneously without the varying tempering conditions affecting the other batches. In addition to the high operational flexibility of the aforedescribed device, the use of the revolving vacuum furnace 5 only as a diffusion furnace with carburization furnaces 6 connected exterior thereto, an optimal use of the device is possible without individual treatment positions requiring idling due to possible interaction with other batches.

The present invention is, of course, in no way restricted to the specific disclosure of the specification and drawings, but also encompasses any modifications within the scope of the appended claims.

What I claim is:

1. A device for heat-treating metallic workpieces in a vacuum, said device comprising:

a revolving vacuum furnace comprising an inlet transfer lock for introducing batches of workpieces into said revolving vacuum furnace and an outlet transfer lock for removing the batches of workpieces from said revolving vacuum furnace;

said revolving vacuum furnace further comprising an annular turntable for transporting the batches of workpieces from said inlet transfer lock to said outlet transfer lock;

at least one carburization furnace, for carburization treatment of the batches of workpieces, connected to said revolving vacuum furnace at least at a peripheral location of said revolving vacuum furnace between said inlet transfer lock and said outlet transfer lock in a direction of transport of the batches of workpieces, wherein said annular turntable transports the batches of workpieces to said at least one carburization furnace.

2. A device according to claim 1, wherein said at least one carburization furnace is a plasma furnace.

3. A device according to claim 1, wherein said at least one carburization furnace is a vacuum furnace.

4. A device according to claim 1, further comprising at least one heating chamber positioned between said inlet transfer lock and said revolving vacuum furnace.

5. A device according to claim 4, further comprising at least one compensation chamber positioned between said heating chamber and said revolving vacuum furnace.

6. A device according to claim 5, wherein said at least one compensation chamber is a hydrogen sputter chamber for surface-cleaning the workpieces.

7. A device according to claim 1, wherein said outlet transfer lock is a cooling chamber.

8. A device according to claim 7, wherein said cooling chamber is a quenching chamber employing gas for quenching.

9. A device according to claim 7, wherein said cooling chamber comprises a quenching bath containing a liquid.

10. A device according to claim 7, further comprising a tempering furnace positioned between said outlet transfer lock and said revolving vacuum furnace.

11. A device according to claim 1, wherein said at least one carburization furnace comprises a first pushing device for pushing the batches of workpieces from said annular turntable into said at least one carburization furnace and a second pushing device for pushing the batches of workpieces from said at least one carburization furnace back onto said annular turntable.

12. A device according to claim 11, wherein said first and second pushing devices are selected from the group of electrical, pneumatic and hydraulic pushing devices.

* * * * *